US009512632B2

(12) United States Patent
Cook

(10) Patent No.: US 9,512,632 B2
(45) Date of Patent: Dec. 6, 2016

(54) METHOD AND APPARATUS FOR A PORTABLE ENCLOSURE

(71) Applicant: Absolute Outdoor, Inc., St. Cloud, MN (US)

(72) Inventor: David G Cook, St. Cloud, MN (US)

(73) Assignee: ABSOLUTE OUTDOOR, INC., St. Cloud, MN (US)

( * ) Notice: Subject to any disclaimer, the term of this patent is extended or adjusted under 35 U.S.C. 154(b) by 114 days.

(21) Appl. No.: 13/626,429

(22) Filed: Sep. 25, 2012

(65) Prior Publication Data

US 2013/0074894 A1 Mar. 28, 2013

Related U.S. Application Data

(60) Provisional application No. 61/538,913, filed on Sep. 25, 2011.

(51) Int. Cl.

| | |
|---|---|
| ***E04H 15/54*** | (2006.01) |
| ***E04H 15/56*** | (2006.01) |
| ***E04H 15/44*** | (2006.01) |
| ***E04H 15/02*** | (2006.01) |
| ***E04H 15/00*** | (2006.01) |
| *E04H 15/12* | (2006.01) |

(52) U.S. Cl.

CPC ..... *E04H 15/54* (2013.01); *E04H 15/001* (2013.01); *E04H 15/02* (2013.01); *E04H 15/44* (2013.01); *E04H 15/56* (2013.01); *E04H 15/12* (2013.01); *Y10T 29/49826* (2015.01)

(58) Field of Classification Search

CPC ..... E04H 15/54
USPC ..... 135/115, 901; 43/1
See application file for complete search history.

(56) References Cited

U.S. PATENT DOCUMENTS

| | | | | |
|---|---|---|---|---|
| 3,570,507 | A | 3/1971 | Kashuba | |
| 3,739,536 | A * | 6/1973 | Ward | 52/63 |
| 3,826,270 | A | 7/1974 | Hentges | |
| 4,067,346 | A * | 1/1978 | Husted | E04H 15/001 135/153 |
| 4,084,597 | A | 4/1978 | Compton | |
| 4,705,717 | A * | 11/1987 | Cain et al. | 442/235 |
| 4,796,649 | A | 1/1989 | Tolomay | |
| 4,926,893 | A | 5/1990 | Klopfenstein et al. | |
| 4,938,243 | A | 7/1990 | Foster | |
| 5,059,463 | A | 10/1991 | Peters | |
| 5,133,378 | A | 7/1992 | Tanasychuk | |
| 6,185,845 | B1 | 2/2001 | Gordon | |
| 6,802,327 | B2 | 10/2004 | Koss | |
| 6,897,167 | B2 | 5/2005 | Gordon | |
| 6,973,742 | B2 | 12/2005 | Gordon | |
| 7,320,332 | B2 | 1/2008 | Reis | |
| 7,665,478 | B2 * | 2/2010 | Wehner | A01G 9/16 135/115 |
| 2004/0048540 | A1 * | 3/2004 | Dailly | A41D 31/0038 442/308 |
| 2004/0087232 | A1 * | 5/2004 | Anderson et al. | 442/228 |
| 2005/0118915 | A1 * | 6/2005 | Heifetz | 442/378 |
| 2006/0021643 | A1 * | 2/2006 | Brensinger | 135/90 |
| 2006/0169729 | A1 * | 8/2006 | Reis | 224/154 |
| 2008/0302049 | A1 * | 12/2008 | Stoneburner | 52/506.02 |
| 2010/0307550 | A1 | 12/2010 | Silverberg et al. | |
| 2014/0060599 | A1 * | 3/2014 | Hotes et al. | 135/91 |

* cited by examiner

*Primary Examiner* — David R Dunn
*Assistant Examiner* — Danielle Jackson
(74) *Attorney, Agent, or Firm* — Barnes & Thornburg LLP

(57) ABSTRACT

A method and apparatus for enclosing a user is provided. The user is shielded from the ambient conditions existing outside a portable enclosure. The enclosure includes an insulation system. The insulation system includes a radiant barrier.

19 Claims, 7 Drawing Sheets

METHOD AND APPARATUS FOR A PORTABLE ENCLOSURE

This application claims priority to and the benefit of U.S. Provisional Patent Application No. 61/538,913, filed Sep. 25, 2011, the disclosure of which is now expressly incorporated herein by reference.

FIELD OF THE INVENTION

The present invention relates generally to portable enclosures, and more specifically to a method and apparatus for protecting occupants from the ambient elements through an illustratively collapsible, portable shelter and is more particularly directed to a lightweight collapsible shelter of the kind utilized by ice anglers and the like.

BACKGROUND AND SUMMARY OF THE INVENTION

It is desirable to have protection from ambient weather conditions or elements when outdoors. Such ambient weather conditions could include wind, rain, sleet, snow, temperature, and UV rays. For example, in the case of those engaged in, or observing ice fishing—namely, ice fishers or anglers—there is typically little or no natural protection from the elements. Other forms of outdoor activities may similarly expose outdoorsmen to elements from which they wish to be shielded. Accordingly, ice anglers and other outdoorsmen utilize various types of fixed and portable shelters or enclosures to shield them from the elements. Representative examples of various portable shelters are described in the following U.S. Patents, the disclosures of which are now incorporated herein by reference, and include:

| U.S. Pat. No. | Patentee | Issue/Pub. Date |
|---|---|---|
| U.S. Pat. No. 7,320,332 | Reis | Jan. 22, 2008 |
| U.S. Pat. No. 6,802,327 | Koss | Oct. 12, 2004 |
| U.S. Pat. No. 5,133,378 | Tanasychuk | Jul. 28, 1992 |
| U.S. Pat. No. 5,059,463 | Peters | Oct. 22, 1991 |
| U.S. Pat. No. 4,938,243 | Foster | Jul. 3, 1990 |
| U.S. Pat. No. 4,926,893 | Klopfenstein et al. | May 22, 1990 |
| U.S. Pat. No. 4,796,649 | Tolomay | Jan. 10, 1989 |
| U.S. Pat. No. 4,084,597 | Compton | Apr. 18, 1978 |
| U.S. Pat. No. 3,826,270 | Hentges | Jul. 30, 1974 |
| U.S. Pat. No. 3,570,507 | Kashuba | Mar. 16, 1971 |
| US 2010/0307550 | Silverberg et al. | Dec. 9, 2010 |

The illustrative embodiments disclosed herein generally comprise an envelope or shell of suitable flexible material, that is generally impervious to the weather conditions that are likely to be encountered. Illustratively the shell is supported by a collapsible frame. While the illustrative enclosure or shelter may take any suitable shape, illustratively it has a generally parallelepiped shape.

It is desirable to provide a lightweight collapsible shelter.

It is desirable to provide a portable shelter having a removable floor.

It is further desirable to insulate the floor and/or the sides and/or the ceiling of the portable enclosure, especially for use in ice angling. Conventional insulating materials, such as goose down, stiff insulating foam or synthetic fibers, to reduce the loss of heat from a user or angler attempt to minimize the heat loss from a user, but none of these insulating materials comprise a radiant barrier that reflects or retains within the enclosure or shelter any desired heating or cooling sources or waves, for example and without limitation the user's body heat back inside the enclosure. Also, the aforementioned insulating materials are not readily washable. Another disadvantage of these insulating materials is that they increase the bulk of an enclosure, which makes a conventional enclosure more difficult to carry and store. A portable enclosure that is easy to manufacture, is easy to use, is lightweight, is easy to carry, is easy to store, is washable and is highly effective at keeping the user warm would be desirable.

Representative examples of a radiant insulation system for use in other than a portable enclosure or shelter includes the system described in U.S. Pat. No. 6,185,845, issued Feb. 13, 2001; U.S. Pat. No. 6,186,897,167 issued May 24, 2005; and U.S. Pat. No. 6,973,742, issued Dec. 13, 2005, each to Gordon, the disclosures of which are now incorporated herein by reference.

The present invention may comprise one or more of the following features and combinations thereof.

The shell is illustratively a generally parallelepiped configuration having a top portion, ceiling or cap as well as integral side portions. Other desired shapes fall within the scope of the invention including for example and without limitation, tetrahedrons, hexahedrons, dodecahedrons, icosahedron, cubes, pyramids, prisms, cones, cylinders, plinths, spheres, and the like. The side portions illustratively may include a side access opening. The side opening may be secured by any suitable means for example through the use of a zipper or a cooperating hook and loop system such as Velcro. Clear portions, for example windows, may be integrated into the side and/or top portions. The shelter may include an integrated or a separate floor. The floor may include a plurality of openings or apertures extending therethrough. The apertures may be aligned with holes opening through for example ice overlaying a body of water. For example, holes may be drilled or cut through, for example, the ice layer on a lake. The top center of the cap illustratively includes a loop. The center of each of the side portions illustratively includes a loop. The shelter may also include a skirt extending around the bottom of the shelter opposite the cap and extending outwardly away from the side portions. An insulation system may be integrated into the shelter. The insulation system may be integrated into the cap, into the side portions, into the floor, or into any combination of the foregoing. The insulation system illustratively may include a radiant barrier. The shelter may be part of a kit or portable system. The kit or portable system may comprise the shelter, along with an anchor system, and a transport system. The anchor system illustratively may comprise anchor members, tie members, and a storage pouch. The transport system may comprise a storage bag or tote. Illustratively, the storage bag may receive therein at least the shelter, with or without the floor and the anchor system.

The portable enclosure or shelter may be provided with an insulation system in various portions of the enclosure as desired. While the insulated portions may comprise any suitable insulation, it is desirable to use the illustrative insulation system which illustratively protects a user in freezing temperatures without adding undue bulk, weight and/or inflexibility to the enclosure. Illustratively, the insulation system comprises a multilayer construction including an outer covering, a radiant barrier and an inner covering where the radiant barrier illustratively is sandwiched between the outer cover and the inner cover. The radiant barrier illustratively reflects the user's, for example and without limitation an angler, body heat back inside the enclosure and keeps the user or angler warm relative to outside ambient temperatures. Illustratively, the insulation system also reflects back and thereby retains inside the enclosure any other source of heat, for example a fire or radiant heater, emanating from inside the enclosure. Illustratively, the insulation system could also reflect back any cold waves. Similarly, the insulation system can reflect away from penetrating inside the enclosure any outside source of heat or cold. The enclosure illustratively remains relatively flexible, lightweight and readily washable despite the use of the radiant barrier in the insulation system. A coating may be added to the top of the floor portion to provide a non-skid surface for walking on, and/or to the bottom of the floor portion to ensure the floor does not move relative to any surface supporting the floor for example a slick surface such as ice.

The illustrative embodiments provide a shelter having an insulation system that reflects heat back inside the shelter to keep a user warm for extended periods, even when the temperature on the outside of the shelter is very cold including well below freezing. Illustratively, the illustrative embodiments also provide a shelter having an insulation system that reflects relatively cold waves back inside the shelter to keep a user cool for extended periods, even when the temperature on the outside of the shelter is very warm. It will be appreciated that the insulation system also serves to reflect away from the inside of the shelter any outside ambient air, thereby serving as a barrier to keep the inside air and the outside air separate in order to maintain the inside at either a warmer or cooler temperature, as desired, relative to the outside ambient temperature. Still, the shelter remains flexible, lightweight, easy to carry, easy to store and readily washable. The floor portion illustratively is removable.

Illustratively, the insulation system comprises an outer covering, a radiant barrier, and an inner covering. The radiant barrier illustratively may comprise two thin sheets of aluminum foil, extruded polymer, and a reinforcing scrim. The extruded polymer and the reinforcing scrim illustratively are sandwiched between the two sheets of aluminum foil to form the radiant barrier. The radiant barrier provides an insulation system that is flexible, lightweight, water-resistant and washable. The radiant barrier reflects the heat from inside the shelter back inside the shelter to keep the user warm relative to temperatures on the outside of the shelter.

Another illustrative insulation system may comprise an outer covering, a radiant bubble barrier and an inner covering. The radiant bubble barrier illustratively comprises two thin sheets of aluminum foil and two sheets of polymeric material with a plurality of air-bubbles between the polymeric sheets. The two polymeric sheets with the plurality of air bubbles between the polymeric sheets are sandwiched between the two sheets of aluminum foil. The air trapped between the two sheets of polymeric material and the two sheets of aluminum foil in the radiant bubble barrier, used in the bottom panel, enhance the insulating effectiveness of the insulation system. The radiant bubble barrier may also provide padding to the floor to increase the comfort of a user or angler situated thereon. The radiant bubble barrier provides an illustrative insulation system that is flexible, lightweight, water-resistant and washable.

It is an object of the invention to provide an insulation system that reflects the user's body heat or other heat source back inside the shelter to increase the effectiveness of keeping the occupant warm when inside the shelter. Reflecting the wearer's heat back into the shelter is accomplished in a novel way by using a radiant barrier or a combination of a radiant barrier and a radiant bubble barrier instead of using normal insulating materials.

It is an object of the invention to provide a shelter that is easy to manufacture and can be manufactured at a low cost.

It is still another object of the invention to provide a shelter that is lightweight and can be stored in a small space and is easy to carry and has a removable insulated floor.

These and other objects and aspects of the present disclosure will become more apparent from the following description of the illustrative embodiment.

DESCRIPTION OF THE ILLUSTRATIVE EMBODIMENTS

Figure 1:
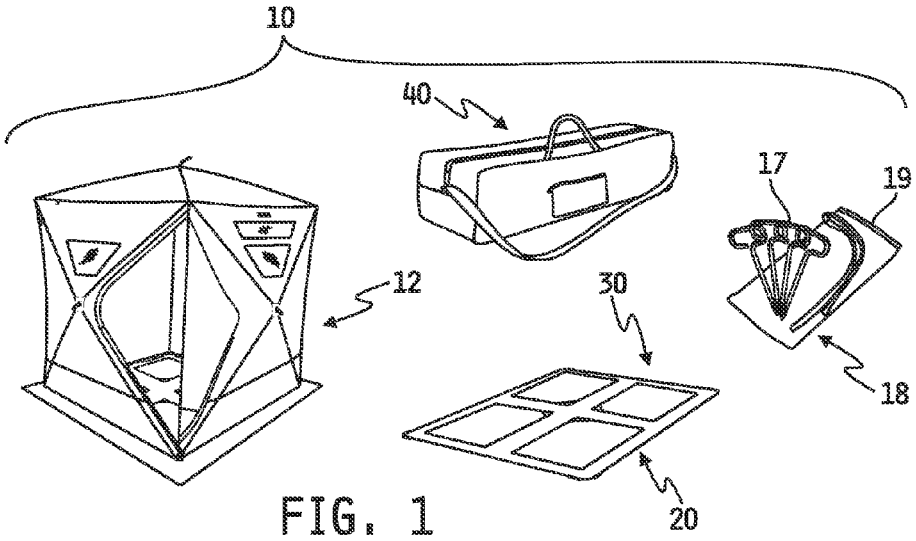
FIG. 1 is a perspective view of an illustrative portable enclosure system kit.
Figure 2:
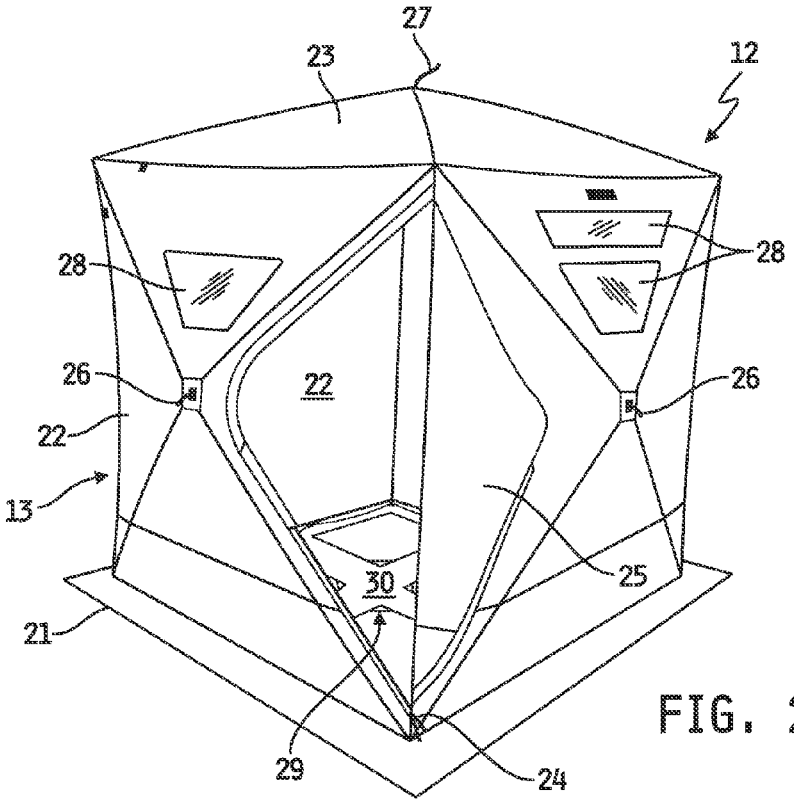
FIG. 2 is a perspective view of an erected illustrative portable enclosure system.
Figure 3:
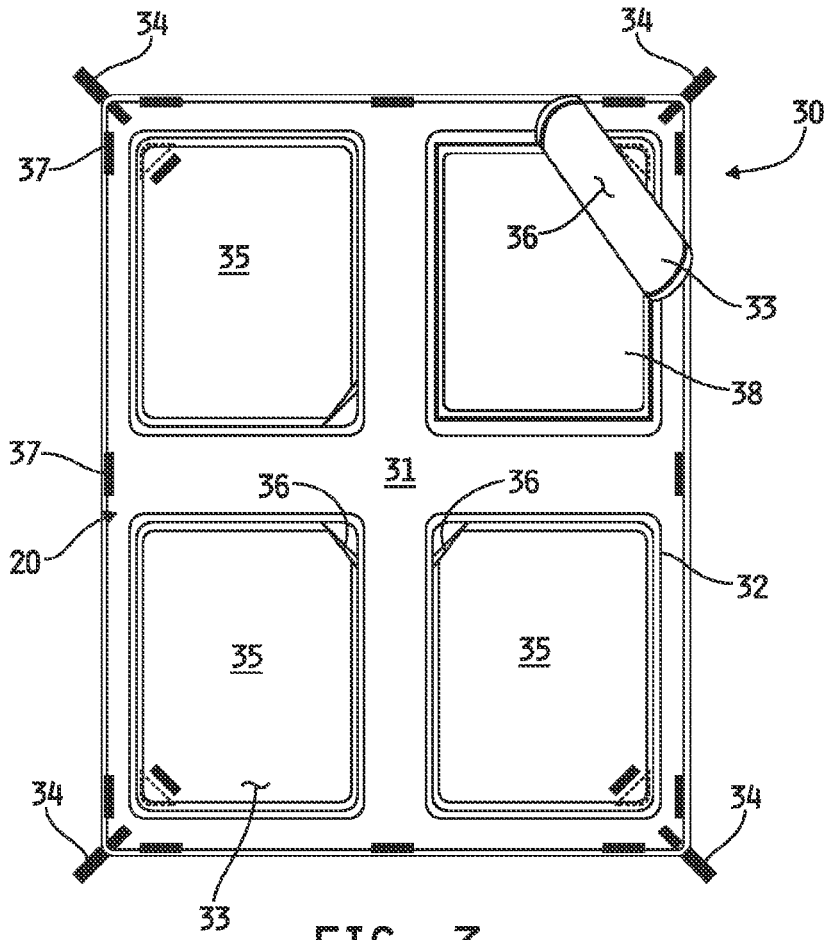
FIG. 3 is a top plan view of an illustrative floor for use in the illustrative portable enclosure system of FIG. 2 found in the kit of FIG. 1.

For the purposes of promoting an understanding of the principles of the invention, reference will now be made to a number of illustrative embodiments illustrated in the drawings and specific language will be used to describe the same.

Figure 4:
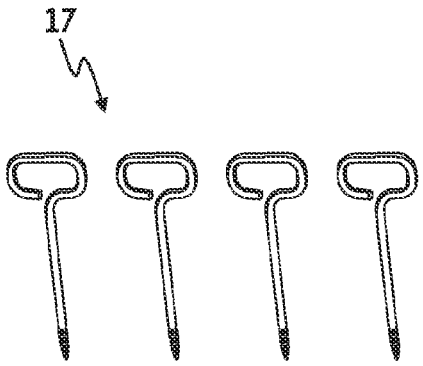
FIG. 4 is a perspective view of illustrative anchors found in the kit of FIG. 1 illustratively for use in the enclosure system of FIG. 2.
Figure 5:
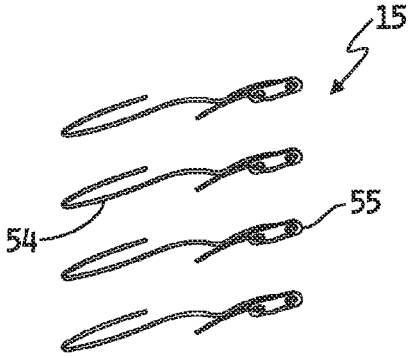
FIG. 5 is a perspective view of illustrative tie members found in the kit of FIG. 1 illustratively for use in the system of FIG. 2.
Figure 6:
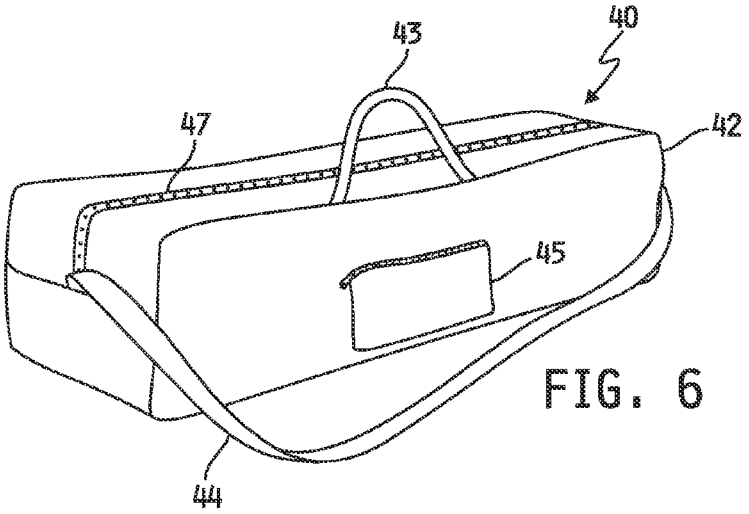
FIG. 6 is a perspective view of an illustrative case found in the kit of FIG. 1.
Figure 7:
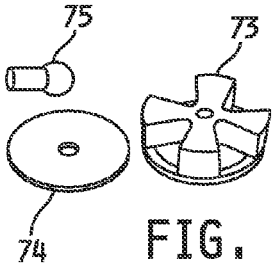
FIG. 7 is a perspective view of components of the system.

Referring now to FIG. 1 and the other drawings in which like elements have been identified by like reference characters, the illustrative portable enclosure or shelter system or kit 10 generally comprises an illustrative shelter enclosure 12, an illustrative anchor kit 18 illustratively including a plurality of illustrative anchor members or spikes 17 (FIGS. 1 and 4), and an illustrative anchor bag, pouch or container 19, an illustrative carry bag, case, transport bag or container 40, and an illustrative insulation floor system 20. The illustrative anchor kit 18 may also include a plurality of anchor connectors 15 as seen in FIG. 5. Each anchor connector 15 illustratively comprises an anchor tie or tie down 54 and an adjustment member or slide 55. The tie down 54 may comprise any suitable anchor tie including for example and without limitation rope or chain. The anchor members or spikes 17 may be manufactured from any suitable material including any metallic, non-metallic, or hybrid material including for example and without limitation, steel, aluminum, wood, plastic, and the like. For example and without limitation the spikes 17 may comprise steel anchors having a diameter of about 0.4 to about 1.2 cm, preferably about 0.8 cm, and a length of about 15 cm to about 20.5 cm and preferably about 18.5 cm. Illustratively, the anchor members 17 and the anchor connectors 15 are received within the anchor bag 19. Illustratively there are four (4) or more anchors 17 and at least a corresponding number of ties 15. The shelter enclosure 12, anchor kit 18 and insulation system floor 20 illustratively are received and transported in the transport bag 40. Illustratively, the carry bag, transport bag, case or container 40 comprises an outer shell 42 defining an inner storage compartment, one or more carry handle(s) 43, one or more carry strap(s) 44, an illustrative utility or storage pocket 45 and a closure 47. Illustratively, the closure 47 may comprise any suitable closure system such as for example and without limitation a zipper, snaps, buttons or a hook and loop system. Similarly, the storage pocket 45, may have an illustrative closure system comprising for example and without limitation a zipper, snaps, buttons or a hook and loop system. The carry handle (s) 43 and carry strap(s) 44 may be connected with the transport, carry or outer shell 42 by any suitable method including for example and without limitation, stitching, glue, melting, rivets, staples, zippers, hook and loop, snaps, ties, and the like. The carry bag may comprise any suitable natural, or synthetic material, including for example and without limitation textiles, flexible polymeric material, animal skins, cloth, plastic, leather, nylon or 600D, or a combination of these materials.

The illustrative shelter or enclosure 12 generally comprises an outer shell, envelope or skin 13 and illustratively comprises a generally right parallelepiped shape and configuration and including a top portion, roof or cap 23, generally upright spaced apart and generally parallel side portions 22 extending generally downwardly away from the top portion 23, and a bottom skirt 21 extending generally perpendicular to and outwardly from the side portions 22. The outer shell 13 may be monolithic. An inner living cavity or living 29 is formed or defined by the cap 23 and sides 22, which are disposed between the living cavity 29 and the outer ambient environment. Illustratively, the preferred measurements of the enclosure are about 72".times.96".times.84", although any suitable dimensions fall within the scope of the invention. The enclosure may be fashioned out of any suitable material, natural or synthetic, including for example and without limitation, textiles, flexible polymeric material, animal skins, cloth, plastic, leather, nylon or the like, or a combination of these materials. Illustratively, one embodiment may comprise padded comp 300D, which may be mildew and fade resistant, CPAI-84. The top 23 and side 22 portions may comprise single or multiple layers of fabric as will be described. In the case of multiple layers of fabric, each of the multiple layers need not be of the same fabric or composition. The material may be quilted. The shelter may weigh any amount but preferred embodiments illustratively may range from about 30 pounds to about 45 pounds and may accommodate up to about four (4) users, occupants or anglers 101. Illustratively, a preferred embodiment of the double layer, quilted embodiment weighs about 40 pounds and the single layer embodiment weighs about 36 pounds. The side portions 23 illustratively may include an ingress/egress access, opening, flap, or door 25, which may be secured by any suitable closure 24 including for example and without limitation a zipper, snaps, buttons, or a hook and loop system. For example and without limitation a 10 pound zipper may be used. The side portions may also include one or more windows 28, which may be fashioned out of any suitable generally clear or translucent material including for example and without limitation plastic or glass. The windows may be fixed from opening or may be configured to be opened as desired. The windows may also include inner and/or outer shades to cover the windows 28 to make them opaque as desired. The sides 22 illustratively may include a side loop or loop 26 and the top portion, roof or cap 23 may include a lift loop 27. The loops 26, 27 illustratively may be connected directly to the shelter 12, or they may be coupled with for example a hub system comprising a hub 73, hub plate 74 and hub ball 75, wherein the hub system and the shelter are coupled or connected together. The shelter 12 illustratively further comprises any suitable support system (not shown) for example and without limitation a frame such as for example a fiberglass pipe frame. Such a frame illustratively may comprise about 11 mm pipe.

Figure 8:
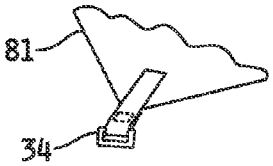
FIG. 8 is a partial top plan view of tie downs of the system of FIG. 2.

In one illustrative embodiment, the insulation floor system 20 comprises a floor insulation system 30. The floor insulation system 30 illustratively comprises a floor bottom 31 and may further comprise an insulation system or radiant barrier 60. Illustratively, bottom 31 comprises a generally rectangular shape of about 72"×96". The floor may be single or multiple layered as desired, and may or may not be quilted as desired. The floor system or bottom 20, 30 illustratively may define one or more fishing holes or apertures 38 through which anglers, users or occupants 101 may access the ground, ice, or water below the floor 20 without interference from the elements; i.e., without needing to leave the inner cavity 29. The apertures 38 may be covered by one or more patches or flaps 33, each comprising an inner or top side 35 facing generally inwardly toward the living cavity 29 and away from the support surface, for example ice, ground or earth, and an outer or bottom side 36 generally facing outwardly from the living cavity 29 toward the supporting ground or ice. The removable floor system 20 may comprise one or more grommets 34, for example and without limitation one at each corner of the floor 31, and one or more connection points 37 spaced along the periphery of the floor 31 for connection with the side portions 22. For example, the connection points 37 may be snaps, hooks, zippers, buttons, hook and loop systems that cooperate with corresponding portions on the side portions 22 and/or the skirt 21. The grommets 34 illustratively may be attached to corners 81 (FIG. 8) and may be configured to cooperate with the anchors 17 to secure the shelter 12. The flaps illustratively may comprise suitable closures 32, for example and without limitation snaps, hooks, buttons, zippers, hook and loop systems to secure the flaps to the floor 31. The system may further comprise various components to aid in the support and assembly of the shelter 12. For example and without limitation hub(s) 73, hub plate(s) 74, and hub ball(s) 75 may be used in manners known to those skilled in the art.

Figure 13:
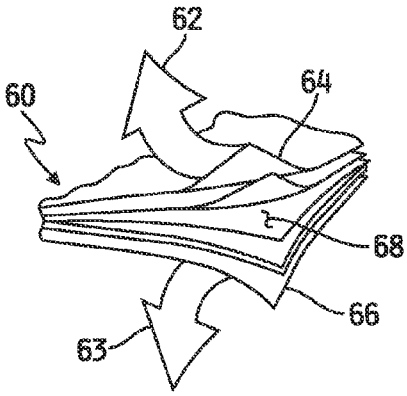
FIG. 13 is a sectional view of an illustrative insulation system of FIG. 2 and FIG. 15.
Figure 15:
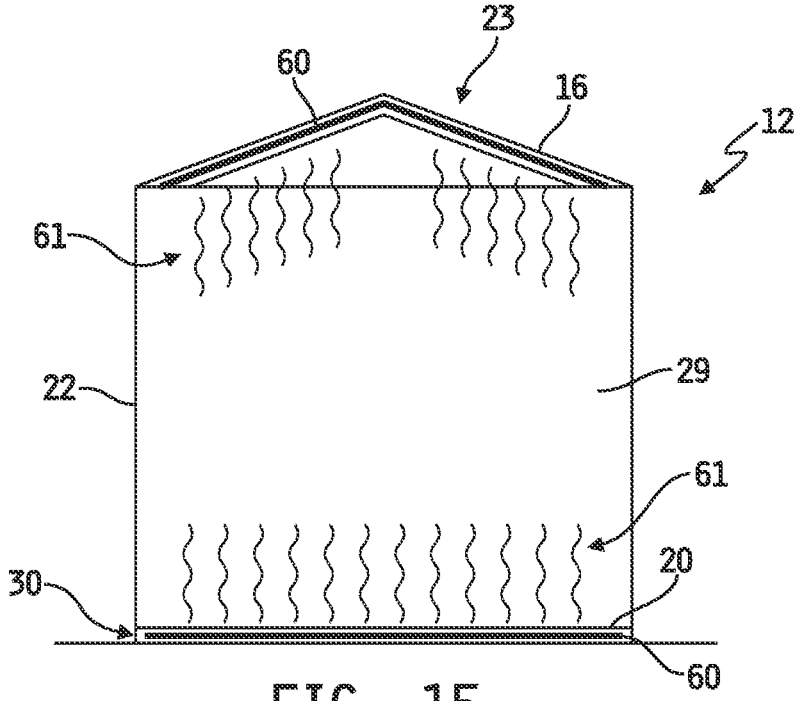
FIG. 15 is a sectional side view of the system of FIG. 2.

Referring to FIG. 13 and FIG. 15, an illustrative radiant barrier 60 of floor system 20 and or of cap 23 insulation system 16 is depicted showing multiple layers that reflect or keep ambient air, for example cold air, represented by arrow 63 out of the cavity 29 and retain or reflect inwardly into the cavity 29 energy, for example heat from the occupant(s) 101 or other heat source as represented by arrows 61 and 62. Those skilled in the art will appreciate that the radiant barrier 60 may also keep or reflect cold air in and keep or reflect warm air out as desired. In short, the radiant barrier 60 or other insulation systems 20, 16 disclosed herein reflect or retain inside the cavity 29 any hot or cold air, and reflects and keeps outside the cavity 29 any ambient sources of heat or cold as desired. The radiant barrier keeps out or excludes ambient conditions existing outside the shelter 12, while maintaining the desired conditions inside the shelter 12. The insulation systems integrated into the floor system 20 and/or cap system 16 may be coextensive or extend for the entirety of the floor system or cap, or may be coextensive or cover merely a portion of the floor system 20 or the cap 16. Similarly, in any of the embodiments, the radiant barrier 60 may be coextensive or extend for the entirety of the floor system or cap, or may be coextensive or cover merely a portion of the floor system 20 or the cap 16 or with all or a portion of the insulation systems integrated or provided therein. It will also be appreciated that the insulation system, including any radiant barrier disclosed herein may be integrated into all or a portion of any one or all of the side portions 22.

Illustratively, the insulation technology floor system 20 and cap system 16 may comprise insulation sold under the trademark ARTICSHIELD. The insulation technology illustratively comprises a multi-layered thermal barrier that captures and returns up to 90 percent of an occupant's, angler's, or user's 101 body heat, which is more effective than thick traditional insulation that only slows body heat loss. This insulation technology provides for relatively thin but warm or insulating technology that illustratively may protect a user 101 from temperatures ranging far below zero. For example and without limitation, the insulation may keep a user comfortably warm in a range from about 50° F. to temperatures far below zero.

Illustratively, in one embodiment, insulation systems 16, 20 comprise an outer covering 56 and, in at least a portion of the upper cover portion, a radiant barrier 60. The bottom panel or floor system 20 comprises an outer covering 56 only. The outer covering 56 used in the insulation systems 16, 20 is a thin sheet of material made from any natural or manmade materials such as for example and without limitation any textiles, flexible polymeric material, animal skins or a combination of these materials in a variety of colors. The radiant barrier 60, used in at least a portion of the upper cover portion, is attached to the inside of the outer covering 56. The radiant barrier 60 can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The preferred radiant barrier 60 provides an insulation system that is flexible, lightweight, water-resistant and washable. The radiant barrier 60 reflects the heat from an occupant or other heat source, or cold from a cold source, back inside the cavity 29 to keep the occupant 101 warm, or cool, even when temperatures on the outside of the enclosure 12 are very cold or very warm.

In another embodiment of the enclosure 12, the insulation systems 16, 20 comprise an outer covering 56 only. The bottom panel 20 comprises an outer covering 56 and a radiant barrier. The radiant barrier 60, used in the bottom 20, is attached to the inside of the outer covering 56. The outer covering 56 and the bottom panel 20 illustratively comprises a thin sheet of material made from any natural or manmade materials such as for example and without limitation any textiles, flexible polymeric material, animal skins or a combination of these materials in a variety of colors. The radiant barrier 60 can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In another embodiment the insulation systems 16, 20 comprise a cover portion and a radiant barrier 60. The bottom panel 20 comprises an outer covering 56 and a radiant barrier 60. The outer covering 56 and the bottom panel 20 illustratively is a thin sheet of material made from any natural or manmade materials such as for example and without limitation any textiles, flexible polymeric material, animal skins or a combination of these materials in a variety of colors. The radiant barrier and the bottom panel 20 are illustratively attached to the inside of the outer covering 56. The radiant barrier 60 illustratively can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

Figure 11:
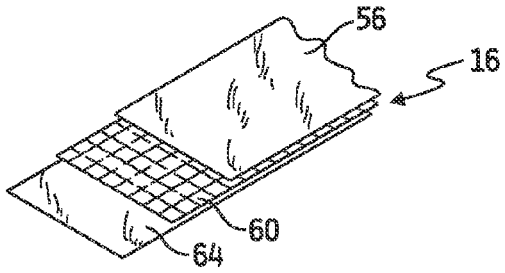
FIG. 11 is an isometric perspective sectional view of an illustrative insulation system of the system of FIG. 2.

In another embodiment, a radiant barrier 60 illustratively is sandwiched between an outer covering 56 and an inner covering 64 as shown in FIG. 11. The bottom panel 20 comprises an outer covering 56 and an inner covering 64. The outer covering 56 and the inner covering 64 and the bottom panel 20 is a thin sheet of material made from any natural or manmade materials such as for example and without limitation any textiles, flexible polymeric material, animal skins or a combination of these materials in a variety of colors. The radiant barrier 60 can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In another embodiment, a radiant barrier 60 illustratively is sandwiched between an outer covering 56 and an inner covering 64 as shown in FIG. 11. The bottom panel 20 comprises a radiant barrier 60 sandwiched between an outer covering 56 and an inner covering 64 as shown in FIG. 11. The outer covering 56 and the inner covering 64 and the bottom panel 20 illustratively is a thin sheet of material made from any natural or manmade materials such as for example and without limitation any textiles, flexible polymeric material, animal skins or a combination of these materials in a variety of colors. The radiant barrier 60 and the bottom panel 20 can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

Figure 12:
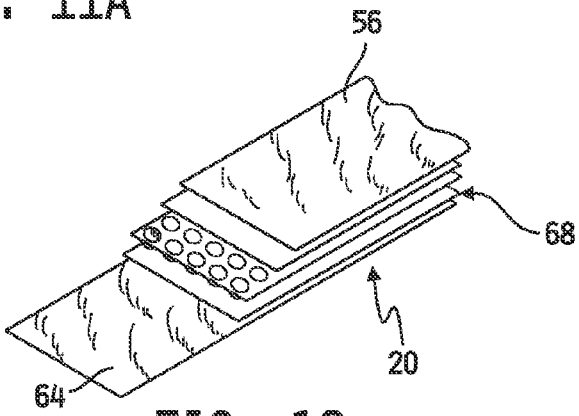
FIG. 12 is an isometric perspective sectional view of an illustrative insulation system of the system of FIG. 2.

In yet another embodiment the insulation system 16, 20 comprises a radiant bubble barrier 68 sandwiched between an outer covering 56 and an inner covering 64 as shown in FIG. 12. The bottom panel 20 comprises a radiant bubble barrier 68 sandwiched between an outer covering 56 and an inner covering 64 as shown in FIG. 12. The outer covering 56 and the inner covering 64 illustratively is a thin sheet of material made from any natural or manmade materials such as for example and without limitation any textiles, flexible polymeric material, animal skins or a combination of these materials in a variety of colors. The radiant bubble barrier 68 can be made from a variety of materials such as metal foil, metallized textiles or metallized flexible polymeric material combined with a sheet of bubble-pack type material. One preferred radiant bubble barrier 68 comprises two sheets of thin aluminum foil and two sheets of polymeric material with a plurality of air bubbles between the polymeric sheets. The two polymeric sheets with the plurality of air bubbles between the polymeric sheets are sandwiched between the two sheets of aluminum foil. The radiant bubble barrier 68 traps air between the two aluminum sheets to further enhance the insulating effectiveness of the system 16, 20. The radiant bubble barrier 68 also provides padding to increase the comfort of the floor 31. The radiant bubble barrier 68 provides an insulation system that is flexible, lightweight, water-resistant and washable.

Figure 11A:
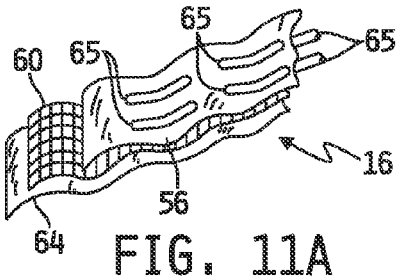
FIG. 11A is an isometric perspective sectional view of an illustrative insulation system of the system of FIG. 2.

In another embodiment, an elastic material is shown in FIG. 11A. As shown in FIG. 11A, the elastic threads 65 cause a corrugated or gathering effect. The elastic threads 65 allow for expansion and may then contract to trap heat.

Figure 14:
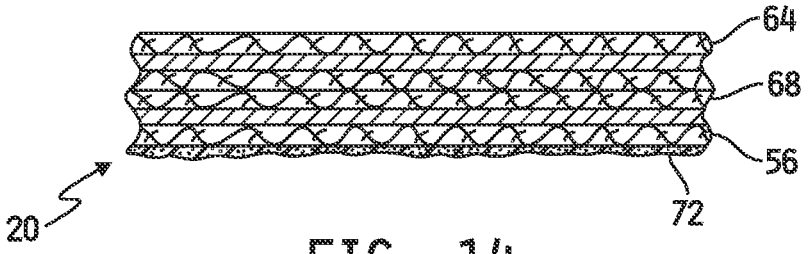
FIG. 14 is a sectional view of an illustrative insulation system of the system of FIG. 2.

An alternative embodiment of the invention is shown in FIG. 12 and FIG. 14, which includes the features discussed above with the addition of a bottom panel exterior coating 72 attached to the outer covering 56 of the bottom panel 20. The bottom panel exterior coating 72 can completely cover the outer covering 56 or can partially cover the outer covering 56 such as comprising a plurality of strips of the bottom panel exterior coating 72 or comprising a plurality of dots of the bottom panel exterior coating 72 attached to the bottom panel 20. The preferred bottom panel exterior coating 72 comprises a plurality of small polymeric dots attached to the bottom panel 20, which will give the floor 20 a non-skid bottom.

Figure 9:
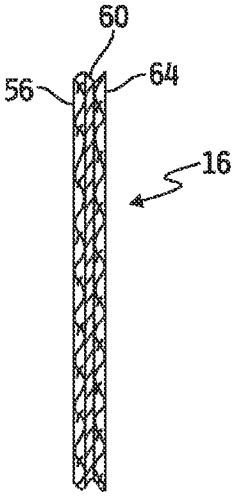
FIG. 9 is a sectional view of an illustrative insulation system of the system of FIG. 2.
Figure 10:
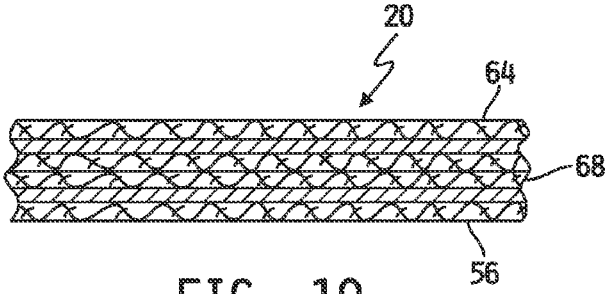
FIG. 10 is a sectional view of an illustrative insulation system of the system of FIG. 2.

As shown in FIG. 9 and FIG. 11, an outer covering 56, a radiant barrier 60, and an inner covering 64 are disclosed. The radiant barrier 60 can be made from a variety of materials such as metal foil, metallized textiles or metallized flexible polymeric material. One preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The radiant barrier 60 provides an insulation system that is flexible, lightweight, water-resistant and washable. The radiant barrier 60 reflects the radiant energy, for example heat, from an occupant or other energy source back inside the cavity 29 of enclosure 12 to keep the occupant(s) 101 warm even when temperatures on the outside enclosure 12 are very cold. The outer covering 56 and the inner covering 64 may comprise a thin sheet of material made from any natural or manmade materials such as for example and without limitation any textiles, flexible polymeric material, animal skins or a combination of these materials in a variety of colors.

Illustratively, the enclosure 12 may accommodate preferably up to four (4) users 101 or anglers 101, although a shelter to accommodate additional users 101 falls within the ambit of the invention. Illustratively, the shelter 12 may have a height 84 inches (213 cm), and a footprint of about 72 inches (183 cm)×96 inches (244 cm). The floor may also be 72 inches (183 cm)×96 inches (244 cm). Preferred embodiments of the shelter may have a weight ranging from about 30 pounds to about 40 pounds. The frame illustratively may comprise a fiberglass pipe poles of about 11 mm. The anchors 17 may be steel having a diameter of about 0.8 cm and a length of about 18.5 cm. Illustratively, there are four (4) anchors. The shell 13 illustratively may be mildew and fade resistant nylon and may comprise padded 300D, CPAI-84. The floor 30 may also have an outer layer 56 of padded fabric 300D that is mildew and fade resistant, for example CPAI-84. The shelter may include polyester mesh. Illustratively, the zipper may be a 10 pound zipper. Illustratively there may be two (2) zippered doors or entrances and four (4) windows. The carry bag 40 may be made from 600D. The bag may have dimensions of about 47 cm×24 cm×157 cm. The shell may comprise a double layer or single layer fabric. The shell illustratively may be quilted. Illustratively, no assembly is required in that the frame may be integrated into the shelter.

Envelope 13 may be comprised of suitable weatherproof material, such as for example and without limitation tent canvas, plastic or the like.

Figure 16A:
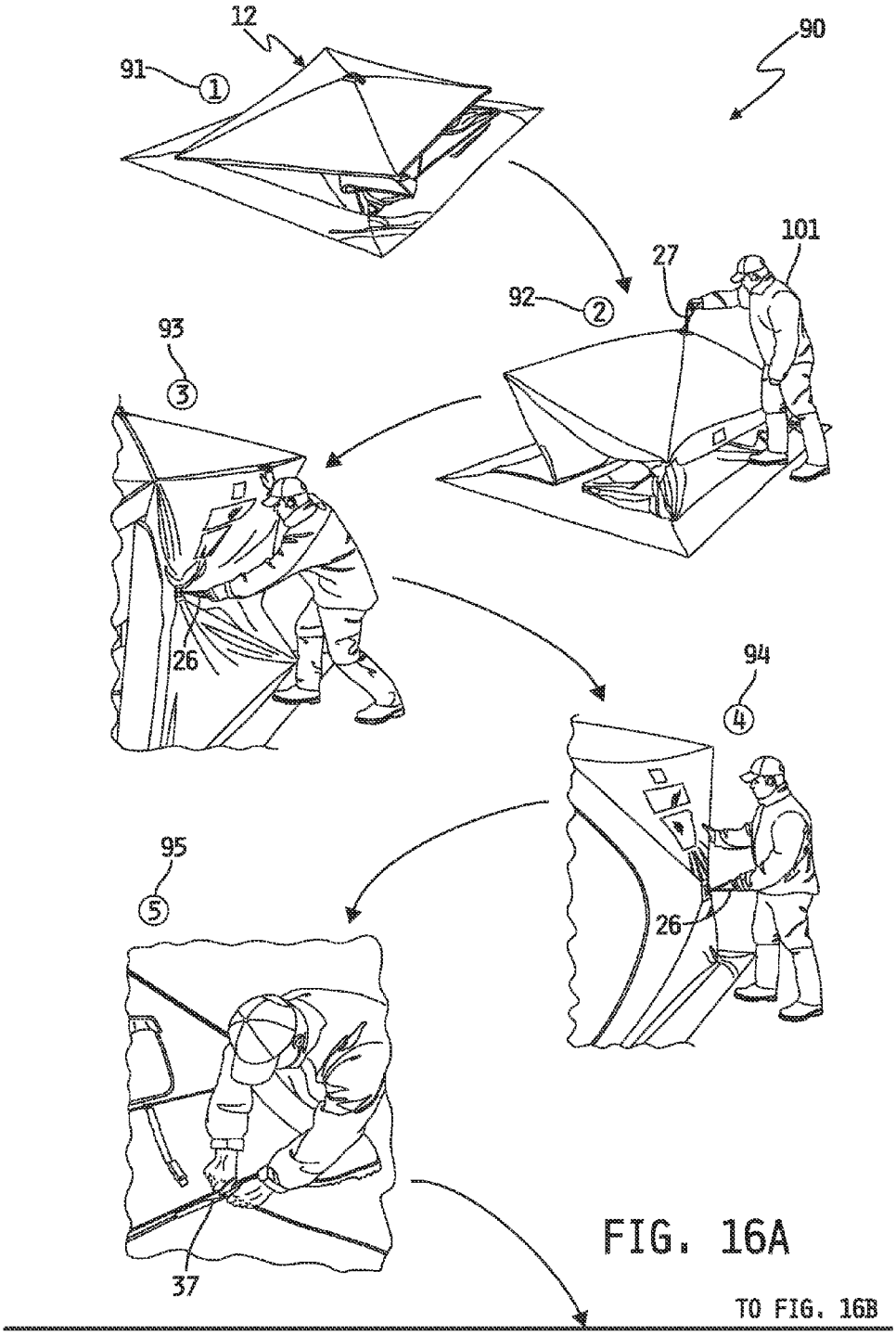
FIG. 16A and FIG. 16B illustrate a method of setting up and taking down the illustrative enclosure system.
Figure 16B:
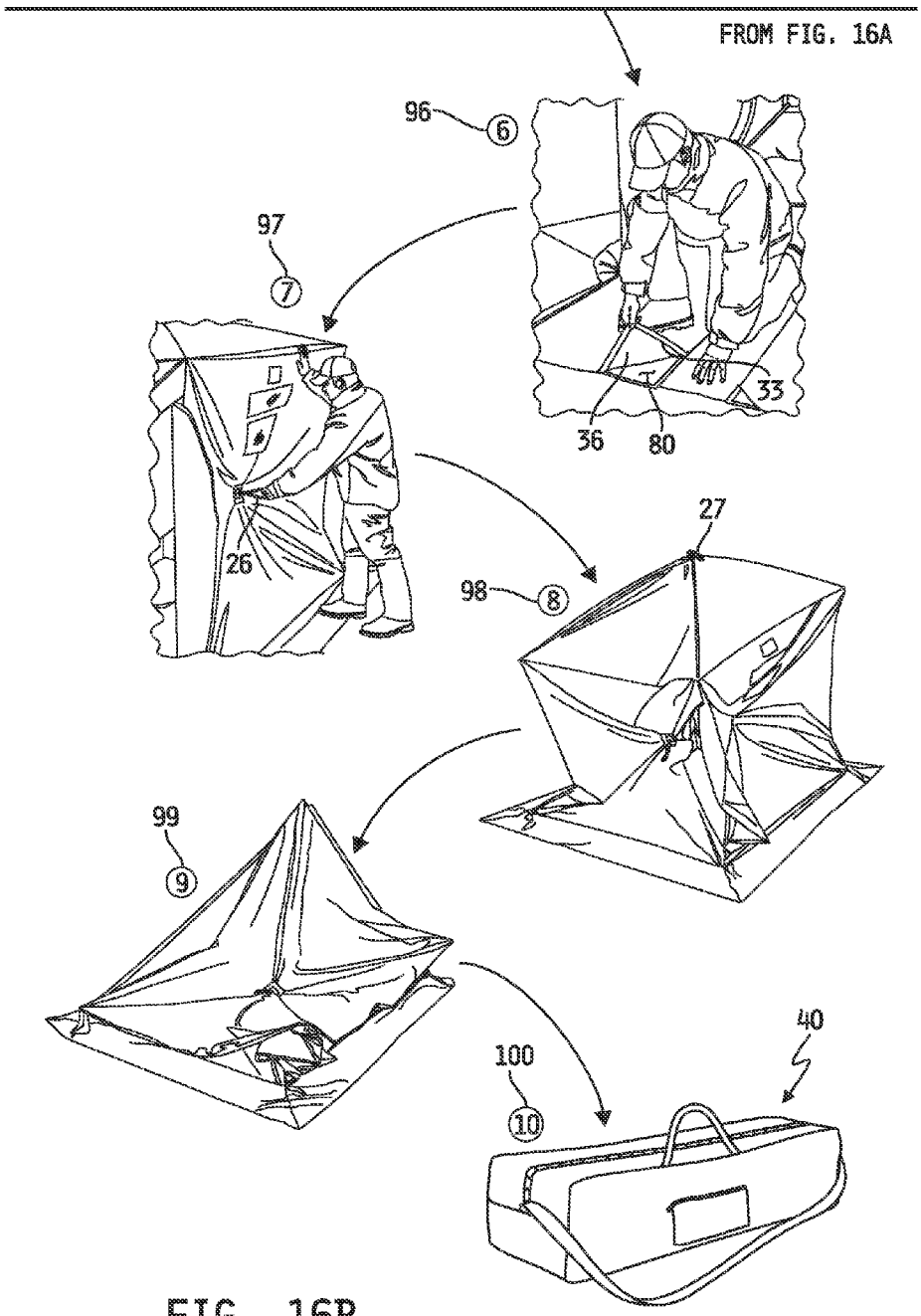

Referring to FIG. 16A and FIG. 16B, an illustrative method of operational use of a portable enclosure or shelter 12 is provided. Illustratively, before attempting to use the shelter operationally, for example on the ice, a user may practice setting up and taking it down at home, for example in the comfort of a climate controlled area. This practice set up may be repeated several times until comfortable. This will make operational use, e.g., on-ice-set-up much easier. Illustratively, no tools are needed for assembly of the shelter 12. It is recommended to clear a 6'×8' area of support surface, for example clear snow off of supporting ice or ground, prior to setting up the shelter. In operation, a user 101 may open, for example by unzipping the storage bag 40 completely and may then remove the shelter 12 from inside of the transport bag 40. A user 101 should use care not to misplace the ice anchor pouch 19. Once out of the bag, the shelter 12 should be opened so that the top is facing upwardly away from the ground. The user should lay the shelter as flat on the ice or ground as possible, making sure that the shelter 12 is not twisted or overlapping any of the poles as seen in image 1 91. Do not force the shelter while unfolding. Referring to (image 2) 92, and ensuring that both doors 25 are open, e.g., unzipped, a user 101 may stand on the skirt 21 of the shelter 12, grasp the loop 27 sewn onto the eyelet in the center of the roof 23 and pull upward on the loop 27 until the roof or cap section 23 pops up (image 2) 92. The user 101 may grasp any one of the loops sewn onto the eyelet 26 in the center of any one of the walls 22 and pull outwardly until the wall pops out (image 3) 93. The user 101 may walk around the entire shelter 12 and pull each loop 26 sewn onto the eyelet in the center of the wall until all sides are popped out (image 4) 94. The shelter 12 should be standing up completely. The user 101 should anchor the shelter to the support surface, for example the ice, by using the provided ice anchors 17 and rope or anchor connectors 15. Illustratively, the user may screw two or more ice anchors 17 into the ice or other support surface, for example the earth or a dock, several feet away from the shelter 12. Illustratively the user may use the provided ropes 15 to tie the hub eyelets to an anchor 17, and the adjustment slides 55 on the rope 54 to achieve desired tension. Illustratively, screw two anchors 17 through the windward corner shelter grommets 34 completely. This will help keep the shelter in place. If using the removable floor system 20, place the floor system 20 inside with panels or flaps 33 facing up 35 and attach connection points or edges 37 to bottom of walls 22 illustratively with illustrative hook and loop closures (image 5) 95. Illustratively, a user may drill openings, for example fishing holes, into the support surface, for example ice, prior to attaching or connecting the floor system 20. Illustratively, use caution when attaching floor 20 if used. A user 101 may open or remove one or more panel(s), patch(es) or flap(s) 33 as needed and desired (image 6) 96 to allow access to the underlying surface 80, which may be for example and without limitation earth, ice, ground, water and the like.

Illustrative operational take down instructions are also depicted in FIG. 16A and FIG. 16B (images 5 and 8 through 10) 95, 97, 98, 99, 100. If using the removable floor system 20, unhook edges 37 from bottom of walls 22 (image 5) 95. Use caution when removing floor system 20. Remove floor system 20 from shelter 12. If desired, roll up, and place the floor system 20 inside of carry bag 40 (image 10) 100. Illustratively, the user should open/un-zip any doors 25. The user may remove all ropes 54 and ice anchors 17 and store them in the provided pouch 19 if desired. Illustratively, in windy conditions, the user may remove ice anchors 17 after collapsing the roof 23 and walls 22. The user 101 may push the center hub 73 on any wall 22 until it collapses inwardly (image 7) 97. The user may continue pushing each wall 22 inwardly until all of the side walls 22 are collapsed. The shelter 12 illustratively will fall to the support surface on its own (image 8) 98. The user 101 illustratively may push the hub 73 of the roof 23 inward until it collapses (image 9) 99. The shelter 12 illustratively will now be flat. The user may gather all corners 81 of the shelter 12 and fold them together, preferably without forcing the shelter 12 when folding. Watch for entanglement of poles (not shown). The user may place the folded shelter 12 and the ice anchor/rope pouch 19 back into the carrying case 40 with the hubs toward the bottom end of the bag. The bag may be closed (image 10) 100. The user may open the shelter 12 and allow it to dry completely before storing.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. An enclosure kit comprising:

a portable enclosure system comprising:

an outer shell having an interior, an exterior, a top portion and a plurality of side portions extending downwardly and away from the top portion, the top portion having a loop with the top portion and loop being configured for pulling the top portion outwardly away from the interior and each of the plurality of side portions having a loop with each side portion and loop being configured for pulling a side portion outwardly away from the interior; and an insulation system, the insulation system and the top portion being integrated with one another;

the insulation system comprising an inner layer and an outer layer with elastic threads, wherein the insulation system includes a radiant heat barrier; and wherein the outer shell is adapted to be in a collapsed configuration for storage and is adapted to be in a use position forming an enclosure.

2. The kit of claim 1 wherein the enclosure system further comprises a floor having a floor insulation system, the floor insulation system and the floor being integrated with one another.

3. The kit of claim 2 wherein the floor insulation system includes the radiant barrier.

4. The kit of claim 3 wherein the radiant barrier is coextensive with at least a portion of the top portion and at least a portion of the floor.

5. The kit of claim 2 wherein the radiant barrier is attached to an inside of the outer layer.

6. The kit of claim 5 wherein the radiant barrier comprises a bubble barrier.

7. The kit of claim 5 wherein the radiant barrier is sandwiched between the inner layer and the outer layer.

8. The kit of claim 7 the floor insulation system further comprises an inner covering and an outer covering, wherein a radiant barrier is sandwiched between the inner covering and the outer covering.

9. The kit of claim 8 wherein the floor and the outer shell are separate and apart from one another.

10. The kit of claim 8 wherein the floor and the outer shell may be coupled together.

11. The kit of claim 8 wherein the floor and the outer shell are integral with one another.

12. The kit of claim 8 wherein the side portions include an integrated insulation system having the radiant barrier.

13. The kit of claim 1 further comprising:

a floor having a floor insulation system and including one or more flaps covering one or more apertures defined in the floor;

an anchor kit, the anchor kit containing therein a plurality of anchor members; and a transport bag; and wherein the transport bag receives therein the enclosure system, the floor, and the anchor kit.

14. The kit of claim 1 wherein when the outer shell is in a use position it can be reconfigured for storage by pressing inward on a central part of each side portion and then pressing inward on a central part of the top portion.

15. The kit of claim 1 wherein the outer shell is adapted to be in a collapsed configuration for storage in a carry bag having dimensions of about 47 cm by 24 cm by 157 cm.

16. The kit of claim 1 wherein the portable enclosure system has a weight of about 30 to 40 pounds.

17. The kit of claim 15 further comprising the carry bag having dimensions of about 47 cm by 24 cm by 157 cm for housing the outer shell in the collapsed configuration, and a floor, ice anchors and ropes.

18. The kit of claim 1 further comprising fiberglass pipe forming a frame.

19. An enclosure kit comprising:

a portable enclosure system comprising:

an outer shell having an interior, an exterior, a top portion and a plurality of side portions extending downwardly and away from the top portion, the top portion having a loop configured for pulling the top portion outwardly away from the interior and each of the plurality of side portions having a loop configured for pulling a side portion outwardly away from the interior, the outer shell further comprising an insulation system comprising an inner layer and an outer layer with elastic threads, wherein the insulation system includes a radiant heat barrier; and the insulation system and the top portion being integrated with one another;

a floor having a floor insulation system and including one or more flaps covering one or more apertures defined in the floor;

an anchor kit, the anchor kit containing therein a plurality of anchor members; and a transport bag; and wherein the transport bag receives therein the enclosure system, the floor, and the anchor kit.

* * * * *